US006619933B2

(12) United States Patent
Ikeda

(10) Patent No.: US 6,619,933 B2
(45) **Date of Patent: *Sep. 16, 2003**

(54) MOTOR-DRIVEN COMPRESSORS

(75) Inventor: Hideo Ikeda, Isesaki (JP)

(73) Assignee: Sanden Corporation, Gunma (JP)

( * ) Notice: Subject to any disclaimer, the term of this patent is extended or adjusted under 35 U.S.C. 154(b) by 179 days.

This patent is subject to a terminal disclaimer.

(21) Appl. No.: 09/938,620

(22) Filed: Aug. 27, 2001

(65) Prior Publication Data

US 2002/0025265 A1 Feb. 28, 2002

(30) Foreign Application Priority Data

Aug. 29, 2000 (JP) ..... 2000-258289

(51) Int. Cl.[7] ..... F04B 17/00

(52) U.S. Cl. ..... 417/410.1; 62/505; 524/544; 700/297; 428/220

(58) Field of Search ..... 417/410.1, 366; 62/505

(56) References Cited

U.S. PATENT DOCUMENTS 3,913,346 A 10/1975 Moody, Jr. et al.
RE30,499 E 2/1981 Moody, Jr. et al.
4,903,497 A 2/1990 Zimmern et al.
4,936,112 A 6/1990 Miller
5,103,652 A 4/1992 Mizuno et al.
5,329,788 A 7/1994 Caillat et al.
5,350,039 A 9/1994 Voss et al.
5,857,348 A 1/1999 Conry
6,086,335 A 7/2000 Bass et al.
6,112,535 A 9/2000 Hollenbeck
6,202,428 B1 3/2001 Katayama et al.
6,225,399 B1 * 5/2001 Araki et al. ..... 524/544
6,278,910 B1 * 8/2001 Miura et al. ..... 700/297
6,321,563 B1 * 11/2001 Ikeda et al. ..... 62/505
6,495,247 B1 * 12/2002 Takezawa et al. ..... 428/220

* cited by examiner

*Primary Examiner*—Teresa Walberg
*Assistant Examiner*—Vinod D. Patel
(74) *Attorney, Agent, or Firm*—Baker Botts L.L.P.

(57) ABSTRACT

A motor-driven compressor is formed integrally with a compressor device for compressing refrigerant and a motor for driving the compressor device. The motor-driven compressor includes a drive circuit. The drive circuit controls the driving of the motor. The drive circuit is provided on an exterior surface wall of a refrigerant suction passages and the drive circuit is coated by or buried within an insulating resin material. In such motor-driven compressors, the drive circuit may be sufficiently cooled without using additional cooling equipment. As a result, providing additional cooling equipment with the drive circuit in the motor-driven compressors is no longer necessary.

6 Claims, 2 Drawing Sheets

MOTOR-DRIVEN COMPRESSORS

BACKGROUND OF THE INVENTION

1. Field of the Invention

The present invention relates to motor-driven compressors formed integrally with a compressor device for compressing refrigerant and a motor for driving the compressor device, and more particularly, to motor-driven compressors that are suitable for use in air conditioning systems for vehicles.

2. Description of Related Art

Motor-driven compressors are driven by power supply, for example, an external power source, such as a battery. Motor-driven compressors formed integrally with a compression portion and a motor for compressing refrigerant are known in the art. In such known compressors, a drive circuit for controlling the driving of the motor is separated from the compression portion and the motor, and an inverter is supplied to the motor for converting power supplied from a power source into a suitable current for the motor. Such an inverter generally comprises a plurality of switching elements. The switching elements may generate a significant amount of heat caused by, for example, electrical loss in the switching elements. Therefore, an air-cooled or a water-cooled type inverter has been used in such known motor driven compressors. In the air-cooled type inverter, a radiator or a fan is employed. In the water-cooled type inverter, a water cooling radiator and water circulating pipes are employed. Such additional equipment increases cost of manufacturing the automotive air-conditioning system.

SUMMARY OF THE INVENTION

A need has arisen to provide motor-driven compressors with drive circuits that do not require additional cooling equipment, such as radiators and fans.

In an embodiment of this invention, a motor-driven compressor is formed integrally with a compressor device for compressing refrigerant and a motor for driving the compressor device. The motor-driven compressor comprises a drive circuit. The drive circuit controls the driving of the motor. The drive circuit is provided on an exterior surface wall of a refrigerant suction passage, and the drive circuit is coated by or buried within an insulating resin material.

Objects, features, and advantages of embodiments of this invention will be apparent to persons of ordinary skill in the art from the following detailed description of the invention and the accompanying drawings.

BRIEF DESCRIPTION OF THE DRAWINGS

The present invention may be more readily understood with reference to the following drawings.

DETAILED DESCRIPTION OF PREFERRED EMBODIMENTS

Figure 1:
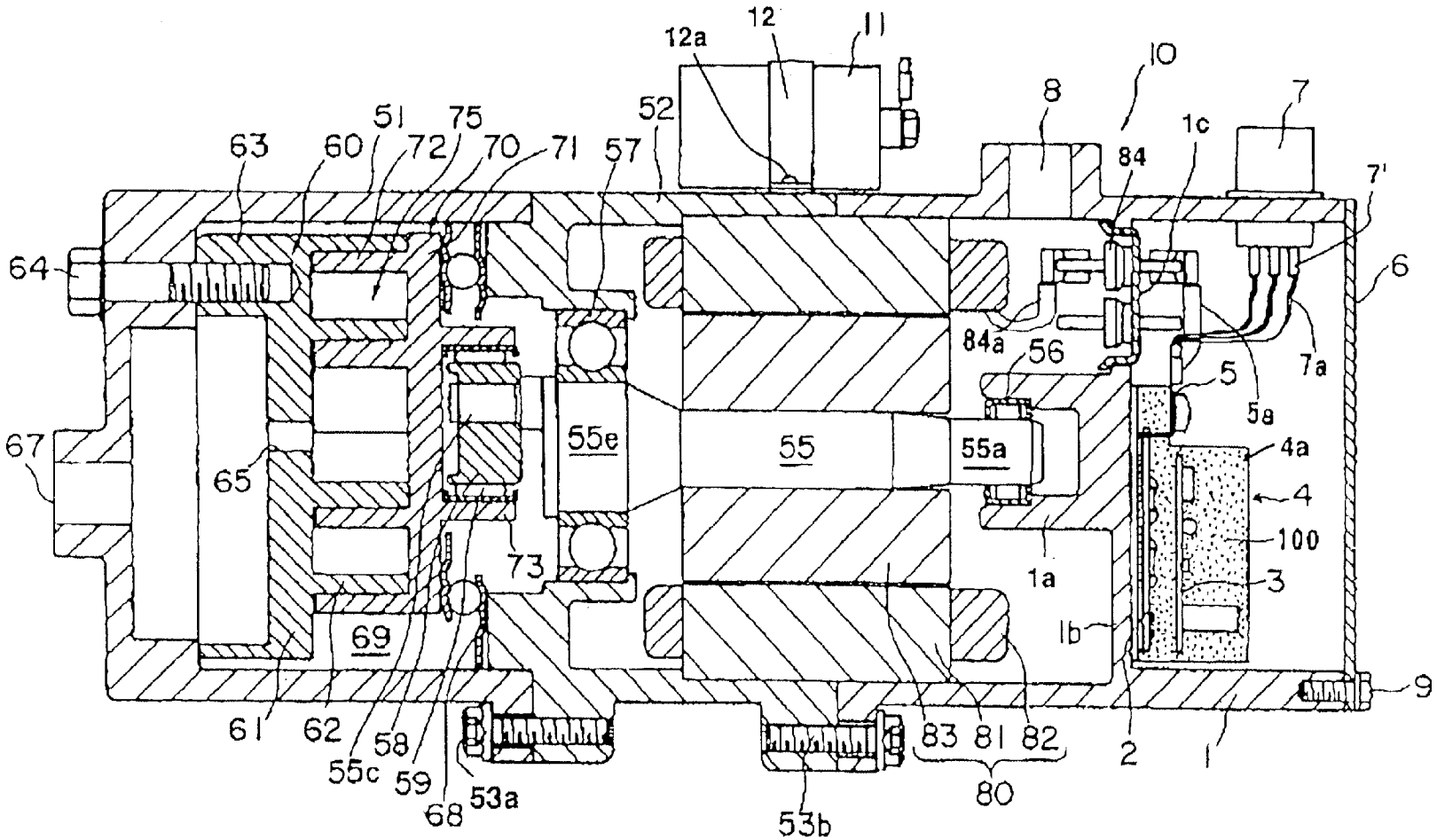
FIG. 1 is a longitudinal, cross-sectional view of a motor-driven compressor, according to an embodiment of the present invention.

Referring to FIG. 1, a motor-driven compressor according to an embodiment of the present invention is shown. A motor-driven compressor 10 has a discharge housing 51, an intermediate housing 52, and a suction housing 1. These housings 51, 52, and 1 are made from a metal material including aluminum. Discharge housing 51 and intermediate housing 52 are connected by a plurality of bolts 53*a*. Intermediate housing 52 and suction housing 1 are connected by a plurality of bolts 53*b*. Discharge housing 51 has a discharge port 67 at its axial end portion. A fixed scroll member 60 and an orbital scroll member 70 are provided in discharge housing 51, so that both scroll members 60 and 70 form a refrigerant compression area 75.

Fixed scroll member 60 includes an end plate 61, a spiral element 62 provided on one surface of end plate 61, and a securing portion 63 formed on the other surface of end plate 61. Securing portion 63 is fixed to an inner surface of the side wall of discharge housing 51 by a plurality of bolts 64. A discharge hole 65 is formed through a center of end plate 61. Orbital scroll member 70 has an end plate 71, a spiral element 72 provided on one surface of end plate 70, and a cylindrical boss portion 73 projecting from the other surface of end plate 71. A rotation prevention mechanism 68 comprises a plurality of balls, each of which travels in a pair of rolling ball grooves formed in opposing ring-shaped races and is provided between the surface of end plate 71 and the axial end surface of intermediate housing 52. Rotation prevention mechanism 68 prevents the rotation of orbital scroll member 70, but allows an orbital motion of scroll member 70 at a predetermined orbital radius with respect to the center of fixed scroll member 60. A suction chamber 69 is formed outside of scroll members 60 and 70. Compression area 75 is defined between fixed scroll member 60 and orbiting scroll member 70. Alternatively, an Oldham coupling may be used as the rotation prevention mechanism.

A drive shaft 55 is disposed in intermediate housing 52 and suction housing 1. Drive shaft 55 has a smaller diameter portion 55*a* at one end portion and a larger diameter portion 55*e* at the other end portion. Suction housing 1 has a partition wall 1*b* extending axially at its middle portion. Partition wall 1*b* extends across the width of suction housing 1. A cylindrical projecting portion 1*a* is provided on one surface of partition wall 1*b* to extend toward the side of compression area 75. Smaller diameter portion 55*a* is rotatably supported by projection portion 1*a* via a bearing 56. Larger diameter portion 55*e* is rotatably supported by intermediate housing 52 via a bearing 57. An eccentric pin 55*c* projects from an end surface of larger diameter portion 55*e* in a direction along the axis of drive shaft 55. Eccentric pin 55*c* is inserted into an eccentric bushing 58, which is rotatably supported by boss portion 73 of orbital scroll member 70 via a bearing 59.

A motor 80, such as a three-phase direct current motor, is disposed in intermediate housing 52 and suction housing 1. Motor 80 has a stator 81, a coil 82, and a rotor 83. Stator 81 is fixed on the inner surface of intermediate housing 52 and suction housing 1. Coil 82 is provided around stator 81. Rotor 83 is fixed on drive shaft 55.

A plurality of sealed terminals 84 are provided on the upper or left portion of partition wall 1*b* in suction housing 1. The right side and the left side of partition wall 1*b*, as depicted in FIG. 1, are separated from each other by partition wall 1*b* and a terminal plate 1*c*. A refrigerant suction port 8 is provided through the outer surface of suction housing 1 at a position between intermediate housing 52 and partition wall 1*b*. The opening of suction housing 1, which is located at an end opposite to the side of intermediate housing 52, is closed by a lid 6. Lid 6 is fixed to the axial end of suction housing 1 via a plurality of fasteners, such as bolts 9. Lid 6 may be formed from the same material as used for suction housing 1, such as aluminum or an aluminum alloy, or, alternatively, may be formed from other materials, such as iron or other magnetic materials. Lid 6 preferably is made from a material capable of shielding against electromagnetic radiation.

An enclosure 4*a* is provided on the exterior surface of partition wall 1*b* within suction housing 1. A drive circuit 4 includes an inverter 2 and control circuit 3. Drive circuit 4 for controlling the driving of motor 80 is located within enclosure 4*a*. Output terminals 5 of inverter 2 are attached to enclosure 4*a*. Enclosure 4*a* is fixed on the surface of partition wall 1*b*. Output terminals 5 are coupled to sealed terminals 84 via a plurality of terminal lead wires 5*a*. Sealed terminals 84 are coupled to motor 80 via a plurality of motor lead wires 84*a*. Enclosure 4*a* is filled with an insulating resin material 100, such as an epoxy resin. A capacitor 11 is provided on the outer surface of the boundary portion between intermediate housing 52 and suction housing 1. Capacitor 11 is attached to this outer surface via an attachment 12 and a fixing pin 12*a*. Capacitor 11 may be provided at a position near the compressor body. A connector 7 is provided on the wall of suction housing 1 on the opposite side of partition wall 1*b* i.e., on the right side of partition wall 1*b* in FIG. 1. Connecter 7 is connected to drive circuit 4 from connector terminals 7' via output terminals 5 through connector lead wires 7*a*. Connector 7 is coupled to an external power source (not shown), such as a battery mounted on the vehicle, through capacitor 11.

In motor-driven compressor 10, when motor 80 is driven by current, such as three-phase current provided from inverter 2, drive shaft 55 is rotated, and orbiting scroll member 70, which is supported by cccentric pin 55*c*, is driven in an orbital motion by the rotation of drive shaft 55. The compressor device comprises scroll members 60 and 70. When orbiting scroll member 70 is driven in an orbital motion, compression areas 75, which are defined between spiral element 62 of fixed scroll member 60 and spiral element 72 of orbiting scroll member 70, move from the outer or peripheral portions of the spiral elements to the center portion of the spiral elements. Refrigerant gas, which enters into suction chamber 69 from an external fluid circuit (not shown) through suction port 8, flows into one of compression areas 75 through an interior space of suction housing 1, motor 80, and an interior space of intermediate housing 52. When compression areas 75 move from the outer portions of the spiral elements, the volume of compression areas 75 is reduced, and refrigerant gas in compression areas 75 is compressed. Compressed refrigerant gas confined within compression areas 75 moves through discharge hole 65 formed in end plate 61. Finally, the compressed refrigerant gas is discharged into an external refrigerant circuit (not shown) through discharge port 67.

In motor-driven compressor 10, because drive circuit 4 is provided on the exterior surface of partition wall 1*b* in suction housing 1, heat generated by inverter 2 of drive circuit 4 is absorbed by lower temperature refrigerant gas through partition wall 1*b*. Thus, drive circuit 4 may remain sufficiently cooled without using additional cooling equipment. Moreover, because drive circuit 4 is coated by or buried within insulating resin material 100, if drive circuit 4 is cooled by lower temperature refrigerant gas through partition wall 1*b*, condensation at a surface of drive circuit 4 may be reduced or eliminated. Therefore, the risk of a dielectric breakdown or a malfunction of drive circuit 4 due to the formation of condensation may be reduced or eliminated, and the risk of an electrical shock may be reduced or eliminated. In addition, because drive circuit 4 is buried within enclosure 4*a* by insulating resin material 100, if the vibration of compression area 75 or the vibration of an engine of the vehicle mounting motor-driven compressor 10 reaches drive circuit 4, electrical components soldered on a printed-circuit board of drive circuit 4 may not be exfoliated from the printed-circuit board. Consequently, damage to electrical components on the printed-circuit board caused by the vibration may be reduced or eliminated. As a result, drive circuit 4 may not be damaged by the vibration.

Drive circuit 4, output terminals 5 of inverter 2, terminal lead wires 5*a*, sealed terminals 84, connector lead wires 7*a*, and terminals 7' of connecter 7 are provided within a closed area surrounded by a metallic wall. Therefore, the damage of these parts due to contact with foreign objects may be reduced or eliminated. Moreover, because electromagnetic noise radiating from terminal lead wires 5*a* is blocked within the closed area surrounded by the metallic wall, malfunction of electrical parts or devices mounted on the vehicles due to electromagnetic noise may be reduced or eliminated.

Figure 2:
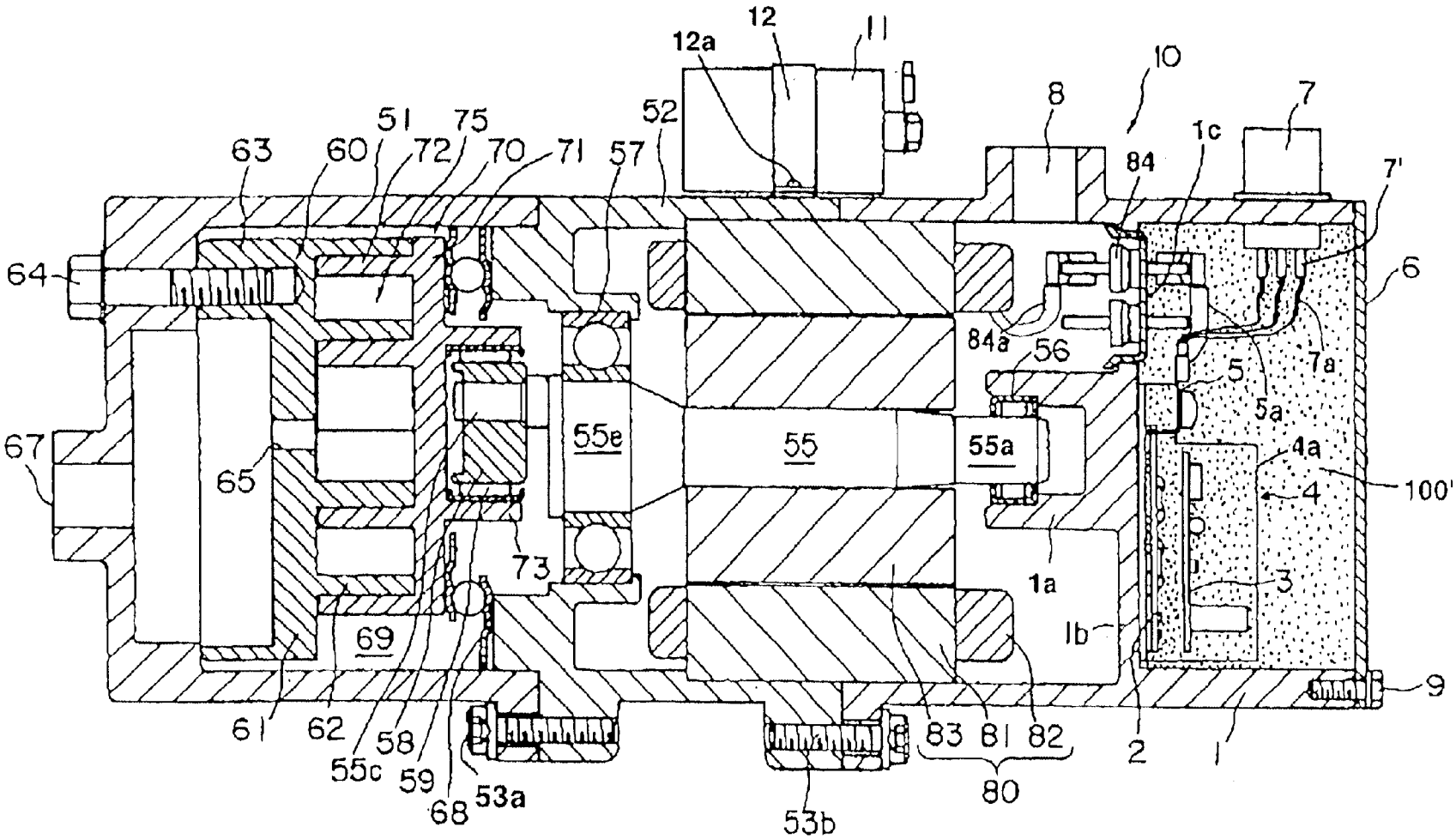
FIG. 2 is a longitudinal, cross-sectional view of a motor-driven compressor, according to another embodiment of the present invention.

Referring to FIG. 2, a motor-driven compressor of another embodiment of the present invention is shown. As shown in FIG. 2, a closed area between an interior side of lid 6 and an outer side of partition wall 1*b* is filled with an insulating resin material 100', such as an epoxy resin. Therefore, output terminals 5 of inverter 2, terminal lead wires 5*a*, sealed terminals 84, connector lead wires 7*a*, and terminals of connecter 7 are covered with insulating, resin material 100'. As a result, the occurrence of an improper connection between terminals and lead wires, or the occurrence of dielectric breakdown due to wear between each of the lead wires that may result from the vibration of compression area 75 or the vibration of the engine of the vehicle mounting motor-driven compressor 10 may be reduced or eliminated.

As described above, in a motor-driven compressor with respect to embodiments of the present invention, because drive circuit 4 is provided on the exterior surface of partition wall 1*b* in suction housing 1, heat generated by inverter 2 of drive circuit 4 is absorbed by lower temperature refrigerant gas through partition wall 1*b*. Therefore, in this embodiment of the present invention, providing additional cooling equipment with drive circuit 4 in the motor-driven compressor is no longer necessary. Moreover, because drive circuit 4 is covered by insulating resin material 100, if drive circuit 4 is cooled by lower temperature refrigerant gas through partition wall 1*b*, the formation of condensation at a surface of drive circuit 4 may be reduced or eliminated. Therefore, the risk of a dielectric breakdown or a malfunction of drive circuit 4 due to the formation of condensation may be reduced or eliminated, and the risk of an electrical shock may be reduced or eliminated.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. A motor-driven compressor formed integrally with a compressor device for compressing refrigerant and a motor for driving said compressor device, said motor-driven compressor comprising:

a drive circuit for controlling the driving of said motor, said drive circuit provided on an exterior surface wall of a refrigerant suction passage, and said drive circuit coated by an insulating resin material.

2. The motor driven compressor of claim 1, further comprising:

a plurality of connector lead wires and a plurality of connecting terminals, which connect between said drive circuit and an external circuit, wherein said connector lead wires and said connecting terminals are buried within said insulating resin material, which fills an area surrounding said connector lead wires and said connecting terminals.

3. The motor-driven compressor of claim 2, further comprising:

a plurality of motor lead wires and a plurality of sealed terminals, which connect between said drive circuit and said motor, wherein said connector lead wires and said connecting terminals connect between said drive circuit and an external circuit, said motor lead wires and said sealed terminals connect between said drive circuit and said motor are provided within a closed space surrounded by a metallic wall.

4. A motor-driven compressor formed integrally with a compressor device for compressing refrigerant and a motor for driving said compressor device, said motor-driven compressor comprising:

a drive circuit for controlling the driving of said motor, said drive circuit provided on an exterior surface wall of a refrigerant suction passage, and said drive circuit buried within said insulating resin material, which fill in an area surrounding said drive circuit.

5. The motor-driven compressor of claim 4, further comprising:

a plurality of connector lead wires and a plurality of connecting terminals, which connect between said drive circuit and an external circuit, wherein said connector lead wires and said connecting terminals are buried within said insulating resin material, which fills in an area surrounding said connector lead wires and said connecting terminals.

6. The motor-driven compressor of claim 5, further comprising:

a plurality of motor lead wires and a plurality of sealed terminals, which are connected between said drive circuit and said motor, wherein said connector lead wires and said connecting terminals connect between said drive circuit and an external circuit said motor lead wires and said sealed terminals connect between said drive circuit and said motor are provided within a closed space surrounded by a metallic wall.

* * * * *